United States Patent [19]

Migliozzi

[11] 4,081,139

[45] Mar. 28, 1978

[54] MULTI-CARRIER DISPENSER FIXTURE FOR SHOWER HEADS

[76] Inventor: Joseph J. Migliozzi, 71 Stanley Ave., Hastings-on-Hudson, N.Y. 10706

[21] Appl. No.: 723,591

[22] Filed: Sep. 15, 1976

[51] Int. Cl.[2] ..... B05B 7/24

[52] U.S. Cl. ..... 239/305; 239/306; 239/314; 211/115; 211/131

[58] Field of Search ..... 222/144.5, 144; 239/303, 304, 305, 306, 315, 316, 314, 394, 507; 211/131 X, 163, 115 X, 95

[56] References Cited

U.S. PATENT DOCUMENTS

| | | | |
|---|---|---|---|
| 2,498,518 | 2/1950 | Zingman et al. | 211/95 |
| 2,613,931 | 10/1952 | Singer | 211/163 X |
| 2,647,797 | 8/1953 | Moss | 239/314 |
| 3,180,579 | 4/1965 | Tomaso | 239/314 |
| 3,298,534 | 1/1967 | Tallman | 211/115 X |

*Primary Examiner*—John J. Love

*Attorney, Agent, or Firm*—James J. Romano, Jr.

[57] ABSTRACT

A simplified, multi-carrier dispenser attachment for shower heads is provided and comprises generally circular support means which are mounted externally of the shower head and which support a spaced plurality of different water soluble substances which may be selectively positioned within the stream of water emanating from the shower head for dissolving therein. In at least one position of the support means, no water soluble substance is disposed in the shower water stream, and a number of adjustment means are provided to enable the ready adjustment in the disposition of the respective substances in the shower water stream to optimize dispensing efficiency.

7 Claims, 2 Drawing Figures

FIG.1
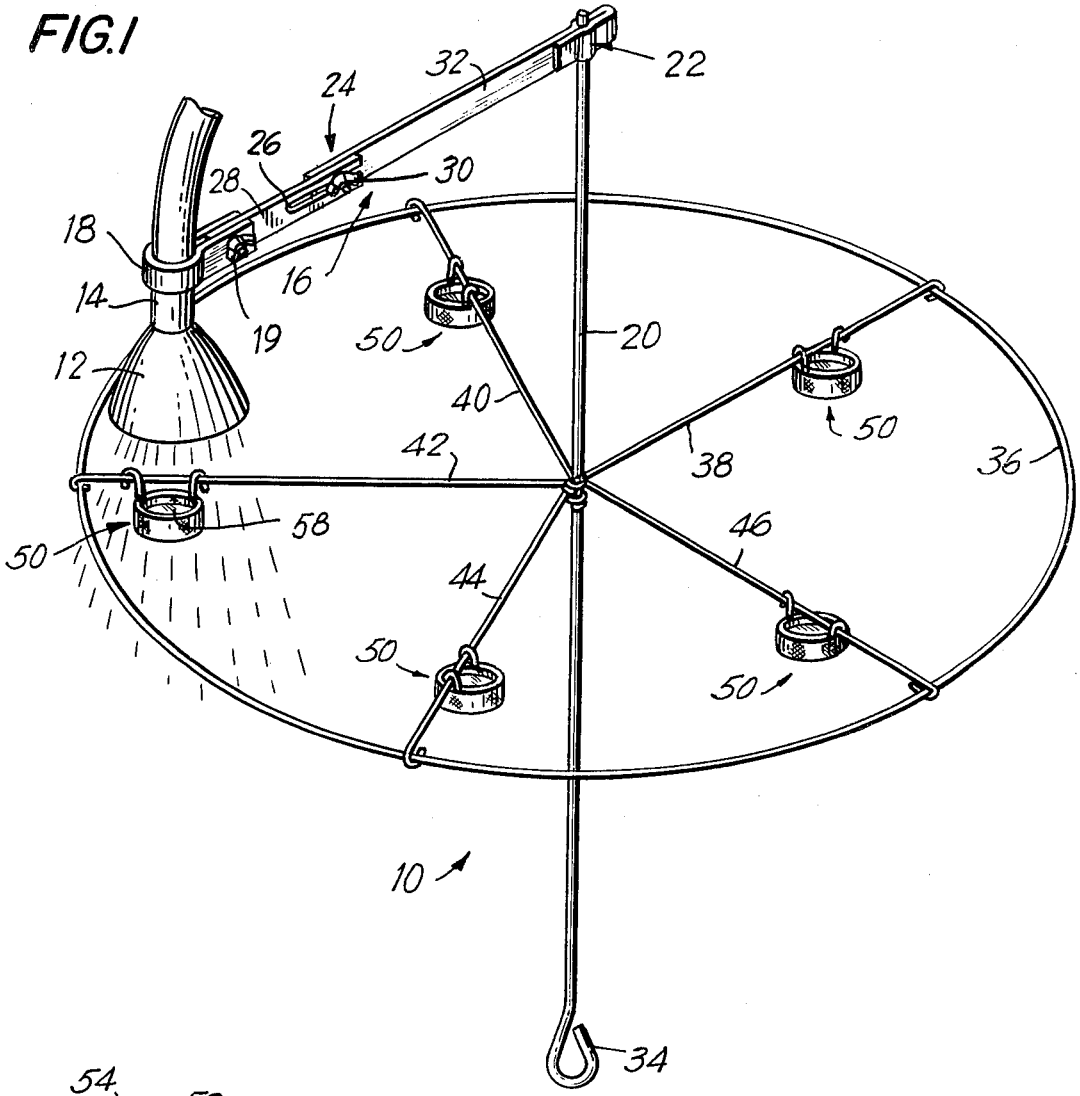
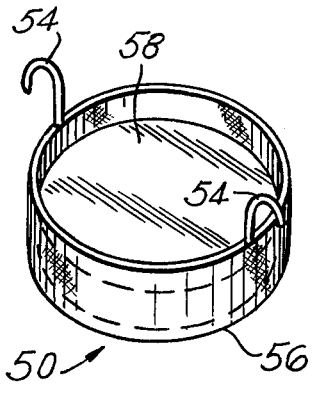
FIG.2

MULTI-CARRIER DISPENSER FIXTURE FOR SHOWER HEADS

BACKGROUND OF THE INVENTION

1. Field of the Invention

This invention relates to a new and improved, multi-carrier dispenser fixture for shower heads which is of particularly simple, economical and widely utilizable construction.

2. Description of the Prior Art

Although a wide variety of dispenser fixtures for shower heads are known in the prior art, it may be understood that the same will generally be found to either be of relatively complex, and thus expensive construction; to require relatively extensive modification and/or dismantling of the shower head for utilization therewith; not to be readily utilizable with many of the existing shower heads; and/or to be capable of dispensing only a single substance into the shower water.

OBJECTS OF THE INVENTION

It is, accordingly, an object of my invention to provide a new and improved, multi-carrier dispenser fixture for shower heads which is of particularly simple and economical construction.

Another object of my invention is the provision of a dispenser fixture as above which, by virtue of the wide range of readily adjustable features included therein, is readily utilizable with the vast majority of existing shower heads without requiring any modification or dismantling whatsoever of the latter.

Another object of my invention is the provision of a dispenser fixture as above which enables the ready and convenient selection of any one of a number of substances to be added to the shower water and which, in addition, is readily and conveniently manipulatable into a position wherein no substance is added to the shower water.

A further object of my invention is the provision of a dispenser fixture as above which requires the use of only readily available materials of proven dependability in the construction thereof to thus provide for long periods of satisfactory, maintenance-free operation.

SUMMARY OF THE DISCLOSURE

As disclosed herein, the new and improved, multi-carrier dispenser fixture of my invention comprises a mounting bracket which is readily clampable onto the water supply pipe of a typical shower head to enable use of the dispenser fixture without any modification or dismantling of the shower head and/or water supply pipe. A shaft is mounted for rotation in said bracket and supports a rim adjacent the opposite extremity thereof by means of spokes which extend from the shaft to the rim. A carrier means taking the form of a support basket is supported from each of said spokes and functions to carry a substance which is to be dissolved into the shower water. A handle is provided at the opposite extremity of the shaft to enable rotation thereof and of the rim and spokes to selectively position any desired one of the baskets, and thus of the substance contained therein, in the path of the shower water; and the angular spacing between the spokes is such that, in at least one angular position of the rim and spokes, no basket and substance is disposed in the path of the shower water. A wide range of positional adjustments is provided to enable use of the dispenser fixture with the vast majority of existing shower heads.

DESCRIPTION OF THE DRAWINGS

The above and other objects and significatn advantages of my invention are believed made clear by the following detailed description thereof taken in conjunction with the following drawings wherein:

FIG. 1 is a perspective view of a new and improved, multi-carrier dispenser fixture constructed and operative in accordance with the teachings of my invention; and FIG. 2 is a perspective view of a carrier means for use with the dispenser fixture of FIG. 1.

DETAILED DESCRIPTION OF THE INVENTION

Referring now to FIG. 1, a simplified, multi-carrier dispenser fixture for shower heads constructed and operative in accordance with the teachings of my invention is indicated generally at 10 and is depicted in operative relationship with a conventional shower head 12 which includes a water supply pipe 14.

The dispenser fixture 10 comprises attachment means taking the form of a two-piece mounting bracket as generally indicated at 16 and which terminates at one extremity thereof in a conventional screw clamp or "Daso" fitting 18 to provide for the convenient clamping of the dispenser fixture 10 to the water supply pipe 14 in the depicted manner; it being understood that this simple and convenient method of supporting the dispenser fixture 10 from the water supply pipe 14 provides the additional advantage of choice in the location on the latter from which the former is supported for purposes described in greater detail hereinbelow.

A support shaft is indicated at 20 and is in turn supported from and mounted for rotation in suitable, but preferably very rudimentary, bearing means or the like 22 which are provided as indicated adjacent the opposite extremity of the mounting bracket 16 and are made somwhat tight-fitting to retain support shaft 20 in whatever angular position the same may be adjusted to as described in greater detail hereinbelow. One example, as depicted, of the manner in which said bearing means 22 may be provided in mounting bracket 16 in particularly rudimentary and economical manner is to simply double over the stock from which the mounting bracket 16 is fabricated at the second-mentioned extremity thereof and to form mating, generally semicircular grooves in the respective inner surfaces thereof to enable the tight grasping and rotatable support of the support shaft 20 therebetween.

Means to enable ready and convenient adjustment in the overall effective length of mounting bracket 16 are indicated generally at 24 and may, for example, take the depicted form of a longitudinally extending, open-ended slot 26 formed in support member piece 28, and a wing-nut or like device 30 which is threaded into mounting bracket piece 32 and extends radially a sufficient distance beyond slot 26 to insure that tightening of the wing nut 30 will firmly grasp mounting bracket pieces 28 and 32 together to result in mounting bracket 16 assuming the desired length as should be obvious.

A handle 34 is provided at the remote extremity of support shaft 20, and is preferably formed as shown by the simple bending-over of the bar stock from which the shaft is fabricated.

A generally circular support rim is indicated at 36 and is preferably formed from a single piece of wire which is bent into the depicted generally circular configuration. Support spokes as indicated at 38, 40, 42, 44 and 46 are provided to extend as shown from support shaft 20 to support rim 36, it being understood that said support spokes are preferably disposed at generally equal angular spacings. For reasons of simplicity and economy of manufacture, the support spokes are preferably attached to the support shaft 20 and support rim 36 by the simple wrapping of the ends of the spokes around said shaft and rim as shown, it being understood that alternative means of attachment in the nature of tack welding or the like may be used for this purpose.

Carrier means taking the form of a support basket are indicated generally at 50 in FIG. 2 and may be seen to comprise a rim 52 having hook-like support arms 54 extending therefrom, and a mesh-like container 56 supported therefrom. A suitably sized and configured cake of a water-soluble substance which is to be dissolved into the shower water is indicated at 58 and is supported as shown in the mesh-like container portion 56 of the support basket 50. For assembly of the dispenser fixture 10, a basket 50 is supported from each of the spokes 38, 40, 42, 44 and 46, preferably by the bending of the respective ends of the support arms 54 over the spoke in question as illustrated to produce a relatively tight attachment while nonetheless enabling sliding adjustment of the basket position along the spoke.

In use of the dispenser fixture 10 of my invention, it may be understood that the same is initially affixed to the water supply pipe 4 by the placement of clamp means 18 therearound in obvious manner and the appropriate tightening of wing nut 19; it being noted in this regard that absolutely no modification whatsoever or dismantling or the like of the shower head 12 and/or water supply pipe 14 is required attendant this affixation of the dispenser fixture 10 thereto. Following this, a cake 58 of a different water soluble substance is readily and conveniently placed in each of the baskets 56, it being here noted that said substances may, for example, be constituted by different kinds of soaps including scented and unscented, and/or those suitable for dry and oily skin; deodorants; shampoos including regular and dandruff types; antiseptic agents; and/or bacteriacidal and fungicidal agents. Thereafter, appropriate adjustment in the position of the respective substance cakes 58 relative to the stream of water which is to issue from shower head 12 may readily and conveniently be effected by one or more of the following procedures: adjustment in the location at which clamping means grasps water supply pipe 14 by loosening and re-tightening of wing nut 19; adjustment in the angularity of mounting bracket 16 relative to water supply pipe 14 by loosening and re-tightening of wing nut 19; adjustment in the effective length of mounting bracket 16 by loosening and re-tightening wing nut 30; and/or adjustment in the radial positions of the baskets 50 on the spokes 38, 40, 42, 44 and 46 by the simple sliding of the former along the latter. Of course, simple trial and error techniques may be utilized, through activation of the shower, to arrive at the optimum dispositions of the substance cakes 58 relative to the stream of water emanating from shower head 12; it being believed by applicant that this particularly wide range of adjustments provided by the construction of the dispenser fixture 10 should render the same satisfactorily and efficiently utilizable with the vast majority of existing shower head assemblies in the complete absence of necessity for any modification and/or dismantling of the latter.

In use, the handle 34 of support shaft 20 is manipulated to place the basket 50 containing the desired cake 58 in the stream of water emanating from the shower head 12 to thus result in the addition, by dissolving, of the substance from which that cake is constituted into the shower water. Of course, more than one cake may be chosen during the course of a shower to thus make possible, for example, the choice of a soap cake during some portion of the shower followed by a deodorant cake during the final stages. Preferably, the angular spacing between the spokes, and thus between the respective cake-containing baskets, is made such that appropriate manipulation of handle 34 can result in a disposition of the respective baskets 50 wherein no cake 58 is disposed in the shower stream to thus provide for the addition of nothing to the shower water during some portion or all of the shower as desired, and the unimpeded flow of the shower water during those periods. Since, as described in detail hereinabove, the dispenser fixture 10 of my invention enables the ready and convenient addition of a wide variety of different substances catering to both male and female tastes to the shower water, it is believed clear that the same is particularly suitable for use by an entire family. Too, the absolute simplicity and convenience of the replenishment of the cakes 58 provided by the dispenser fixture 10 is believed so obvious as to require no detailed discussion.

The dispenser fixture 10 of my invention may, of course, be readily fabricated from any suitably rust-resistant metal in the nature of aluminum or stainless steel, although it will be understood that a suitable plastic material might alternatively be utilized in the interests of economy of manufacture.

Various changes may, of course, be made in the illustrated embodiment of my invention without departing from the spirit and scope thereof as defined in the appended claims.

What is claimed is:

1. A multi-carrier dispenser fixture for shower heads comprising, in combination, attachment means for attaching said dispenser fixture to but externally of the shower head and the water supply pipe which feeds the same and externally of the water flow path through the shower head and water supply pipe, support means rotatably supported from said attachment means, a plurality of spaced, generally open-topped, carrier means suspended from said support means for water soluable substances, each of which may be selectively rotated into position externally of the shower head and in the path of the shower water emanating thereform to result in the selective dissolving of said substances into the shower water, said carrier means being sufficiently spaceable on said support means so that the rotation of any one of said carrier means into position in the path of the shower water will result in all other of said carrier means being positioned without the path of said shower water.

2. A multi-carrier dispenser fixture as in claim 1 wherein, said attachment means comprise a mounting bracket including clamping means which may be clamped around the water supply pipe of the shower head.

3. A multi-carrier dispenser fixture as in claim 2 wherein, said support means comprise a shaft which is rotatably supported from said bracket, and generally circular rim means supported from said shaft by a plurality of angularly spaced spoke-like members which extend from the former to the latter.

4. A multi-carrier dispenser fixture as in claim 3 wherein said carrier means comprise a plurality of basket-like members, each of which is supported from a different one of said spoke-like members and is operable to carry a different one of said water soluble substances.

5. A multi-carrier dispenser fixture as in claim 4 wherein the angular spacing between said spoke-like members and the diameter of said generally circular rim means are such that said support means may be rotated into one or more positions relative to said shower head wherein no substance is disposed in the path of the shower water.

6. A multi-carrier dispenser fixture as in claim 4 wherein said mounting bracket clamping means are pivotally secured to said mounting bracket to enable ready adjustment in the angular disposition of said mounting bracket relative to said shower head and water supply pipe, and wherein said mounting bracket further comprises adjustment means to enable ready adjustment in the length of said mounting bracket and thus in the distance between said shower head and said support shaft.

7. A multi-carrier dispenser as in claim 4 wherein said basket-like members are slidably disposed on said spoke-like members to enable ready adjustment in the respective dispositions of said basket-like members along the latter relative to the stream of water emanating from said shower head.

* * * * *